US011285590B2

(12) United States Patent
Danebergs

(10) Patent No.: US 11,285,590 B2
(45) Date of Patent: Mar. 29, 2022

(54) METHOD, MONITORING NODE AND COMPUTER PROGRAM OF MONITORING ENERGY FLOW IN A TIGHTENING TOOL

(71) Applicant: ATLAS COPCO INDUSTRIAL TECHNIQUE AB, Stockholm (SE)

(72) Inventor: Andris Danebergs, Svädsjö (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 516 days.

(21) Appl. No.: 16/348,964

(22) PCT Filed: Dec. 4, 2017

(86) PCT No.: PCT/EP2017/081286
§ 371 (c)(1),
(2) Date: May 10, 2019

(87) PCT Pub. No.: WO2018/108593
PCT Pub. Date: Jun. 21, 2018

(65) Prior Publication Data

US 2019/0283223 A1 Sep. 19, 2019

(30) Foreign Application Priority Data

Dec. 15, 2016 (SE) ..... 1630297-8

(51) Int. Cl.
*B25B 23/142* (2006.01)
*B25B 21/00* (2006.01)
*B25B 23/147* (2006.01)

(52) U.S. Cl.
CPC ..... *B25B 23/1425* (2013.01); *B25B 21/00* (2013.01); *B25B 21/008* (2013.01); *B25B 23/147* (2013.01)

(58) Field of Classification Search
CPC ... B25B 21/00; B25B 21/008; B25B 23/1425; B25B 23/147
See application file for complete search history.

(56) References Cited

U.S. PATENT DOCUMENTS 6,167,788 B1 * 1/2001 Schonberger ..... B25B 23/14 73/862.23
7,090,030 B2 * 8/2006 Miller ..... B25B 21/00 173/182

(Continued)

FOREIGN PATENT DOCUMENTS

EP 2248632 A1 11/2010
WO 2016001209 A1 1/2016

OTHER PUBLICATIONS

International Search Report (ISR) and Written Opinion dated Mar. 13, 2018 issued in International Application No. PCT/EP2017/081286.

*Primary Examiner* — Francis C Gray
(74) *Attorney, Agent, or Firm* — Holtz, Holtz & Volek PC

(57) ABSTRACT

A method performed by a monitoring node associated with a tool communication network of monitoring energy flow in a tightening tool connected to the communication network includes receiving, from the tightening tool, parameter values relating to current fed (I) into the tightening tool, angle (α) of a rotor in the tightening tool and torque (T) applied to a joint by the tightening tool. The method also includes calculating energy input to the tightening tool based on the received parameter values, calculating energy transferred to the joint by the tightening tool based on the received parameter values relating to the torque applied to the joint by the tightening tool and the angle (α) of the rotor in the tightening tool. The method further includes detecting that (Continued)

the calculated energy input deviates from the calculated energy transferred to the joint by more than a predetermined value.

20 Claims, 4 Drawing Sheets

(56) References Cited

U.S. PATENT DOCUMENTS

| | | | | |
|---|---|---|---|---|
| 7,493,830 | B2 * | 2/2009 | Escoe | B25B 23/1425 73/862.21 |
| 2004/0040727 | A1 * | 3/2004 | Miller | B25B 21/00 173/2 |
| 2010/0265097 | A1 * | 10/2010 | Obatake | B25B 23/14 340/870.4 |
| 2015/0247745 | A1 | 9/2015 | McClogan | |
| 2016/0129569 | A1 | 5/2016 | Lehnert et al. | |
| 2016/0207180 | A1 * | 7/2016 | Hohmann | B25B 21/00 |
| 2017/0153631 | A1 | 6/2017 | Jonsson | |
| 2019/0168364 | A1 * | 6/2019 | Klotblixt | B25B 21/02 |

* cited by examiner

METHOD, MONITORING NODE AND COMPUTER PROGRAM OF MONITORING ENERGY FLOW IN A TIGHTENING TOOL

TECHNICAL FIELD

The present invention relates generally to a method, a monitoring node and a computer program of monitoring energy flow in a tightening tool.

BACKGROUND ART

Tightening tools and systems with tightening tools, including portable tightening tools such as power wrenches operated by an operator, are often used in production work. A common application is in assembly lines. Nowadays, tightening tools in assembly lines may have a controller connected to them and the controller controls the work performed by the tool so that the tool works automatically. With other words the controller sees to that the tool is operated correctly, e.g. performing a wrench operation with the correct torque etc.

Sometimes it is necessary to update the controller with new information. For example, the tools may have to perform new operations, change dimensions or torque or just adjust the current operation for a better performance.

In PCT/EP2015/064814 there is disclosed a tool communications network for enabling remote control of tightening tools. This tool communications network is very useful for performing updates to many tool controllers at the same time, minimizing the time of an operator during the update. The mentioned tool communication network may also be used by the tool controllers to collect data of the result of work performed by the tightening tools, such as collecting the torque used for tightening a bolt or nut. Collecting such data is valuable for increasing traceability of products produced in an assembly line. Thus, the tool communication network has greatly improved the efficiency and quality of work at assembly lines.

However, there are still improvements to be done. Such improvement areas may be to foresee or detect impending tool failure, detect variations in material of the product assembled at the assembly line and operator behavior at a manufacturing station of the assembly line. Today, a production technician may through experience know what station in the assembly line that usually has problems with tool usage or with operator behavior. This experience may be gained by observing the operators and/or looking at error codes displayed by the tightening system and other equipment. Observing operator behavior and error codes to gain an overview of the assembly line requires a lot of experience and also time from the production technician. Since the production technician only can be at one place at a time it will not only be difficult, but impossible, to observe the whole assembly line at once. This will lead to disturbances in the production, since there will be failures due to defective tightening tools, wrong operator behavior or material deficiencies.

Thus, there is a need to get a better overview of an assembly line in order to foresee and reduce failures that may lead to interrupted production.

SUMMARY

It is an object of the present invention to address at least some of the problems and issues outlined above. It is possible to achieve these objects and others by using a method, a monitoring node and a computer program for monitoring energy flow in a tightening tool.

According to one aspect, a method is provided performed by a monitoring node that is associated with a tool communication network to which also the tightening tool is connected. The method comprises receiving, from the tightening tool, parameter values relating to current fed into the tightening tool, angle of a rotor in the tightening tool and torque applied to a joint by the tightening tool, calculating the energy put into to the tightening tool based on the received parameter values relating to the current fed into the tightening tool and the angle of the rotor in the tightening tool, and calculating the energy transferred to the joint by the tightening tool based on the received parameter values relating to the torque applied to the joint by the tightening tool and the angle of the rotor in the tightening tool. The method furthermore comprises detecting that the calculated energy put into to the tightening tool deviates from the calculated energy transferred to the joint by the tightening tool with more than a predetermined value.

In an embodiment the method also comprises transmitting an alarm message in response to detecting that the calculated energy put into to the tightening tool deviates from the calculated energy transferred to the joint by the tightening tool with more than a predetermined value.

In another embodiment the method comprises sending a request for parameter values to the tightening tool, via the communication network.

In yet another embodiment the receiving step of the method further comprises receiving, from the tightening tool, a parameter value relating to a temperature of the tightening tool, and calculating the predetermined value such that it correlates with the parameter value relating to the temperature of the tightening tool, i.e. increasing temperature leads to increasing predetermined value.

In a further embodiment the receiving step of the method comprises receiving, from a second tightening tool connected to the communication network, a parameter value relating to a temperature of the second tightening tool, the detecting step further comprises detecting that the parameter value relating to the temperature of the tightening tool deviates with more than a predetermined temperature range from the parameter value relating to the temperature of the second tightening tool and wherein transmitting the alarm message comprises transmitting information about the deviation in the parameter values relating to the temperatures of the tightening tool and the second tightening tool.

In another embodiment the method comprises retrieving, a parameter value relating to desired tightening torque for tightening the joint, and detecting that the retrieved parameter value relating to the desired tightening torque deviates from the received parameter value for the torque applied to the joint by the tightening tool and wherein transmitting the alarm message comprises transmitting information that the desired tightening torque deviates from the received parameter value for the torque applied to the joint by the tightening tool.

According to another aspect a monitoring node for monitoring energy flow in a tightening tool and associated with a tool communication network is provided. The tightening tool is also connected to the communications network. The monitoring node comprises a processor and a memory, the memory comprising instructions which when executed by the processor causes the monitoring node to receive, from the tightening tool, parameter values relating to current fed into the tightening tool, angle of a rotor in the tightening tool and torque applied to a joint by the tightening, calculate the energy put into to the tightening tool based on the received parameter values relating to the current fed into the tightening tool and the angle of the rotor in the tightening tool and calculate the energy transferred to the joint by the tightening tool based on the received parameter values relating to the torque applied to the joint by the tightening tool and the angle of the rotor in the tightening tool. The monitoring node is further caused to detect that the calculated energy put into to the tightening tool deviates from the calculated energy transferred to the joint by the tightening tool with more than a predetermined value.

In an embodiment the monitoring node is further caused to transmit an alarm message in response to detecting that the calculated energy put into the tightening tool deviates from the calculated energy transferred to the joint by the tightening tool with more than a predetermined value.

The monitoring node is, in another embodiment, caused to send a request for parameter values to the tightening tool, via the communication network.

In yet another embodiment the monitoring node is further caused to receive, from the tightening tool, a parameter value relating to a temperature of the tightening tool and calculate the predetermined value such that it correlates with the parameter value relating to the temperature of the tightening tool, i.e. increasing temperature leads to increasing predetermined value.

In another embodiment the monitoring node is further caused to receive, from a second tightening tool connected to the communication network, a parameter value relating to a temperature of the second tightening tool, detect that the parameter value relating to the temperature of the tightening tool deviates with more than a predetermined temperature range from the parameter value relating to the temperature of the second tightening tool and wherein transmitting the alarm message comprises transmitting information about the deviation in the parameter values relating to the temperatures of the tightening tool and the second tightening tool.

In a further embodiment the monitoring node is further caused to retrieve a parameter value relating to desired tightening torque for tightening the joint, detect that the received parameter value relating to the desired tightening torque deviates from the received parameter value for the torque applied to the joint by the tightening tool and wherein transmitting the alarm message comprises transmitting information that the desired tightening torque is smaller than the received parameter value for the torque applied to the joint by the tightening tool.

According to another aspect, a computer program and a computer program product comprises computer readable code is provided, which when executed on a processor of the monitoring node causes the monitoring node to behave as a monitoring node described in previous sections.

Further possible features and benefits of this solution will become apparent from the detailed description below.

BRIEF DESCRIPTION OF DRAWINGS

The Solution Will Now be Described in More Detail by Means of Exemplary Embodiments and with Reference to the Accompanying Drawings, in which.

DETAILED DESCRIPTION

Briefly described, a solution is provided to enable monitoring energy flow in a tightening tool in order to foresee or detect impending tool failure, detect variations in material of the product assembled at the assembly line and operator behavior at a manufacturing station of the assembly line. In an environment where a number of tightening tools are used, normally controlled by controllers, the tightening tools may be configurable for different operations. A specific tightening tool may further be a part of a manufacturing station together with material for production, arrangements for material handling, different accessories or fittings for the tightening tool, and so forth. The tightening tool is part of a tool communication network. The tool communications network may be operated in a small manufacturing plant in a clean environment. The tool communications network may be operated in a manufacturing environment distributed over several buildings or remote locations. The tool communications network may be operated in a manufacturing environment in a factory with a challenging environment of dirt, aggressive chemicals, electrical disturbances, sometimes challenging for communication equipment and computers. A suitable tool communications network for use together with the present invention is described in greater detail in PCT/EP2015/064814.

Figure 1:
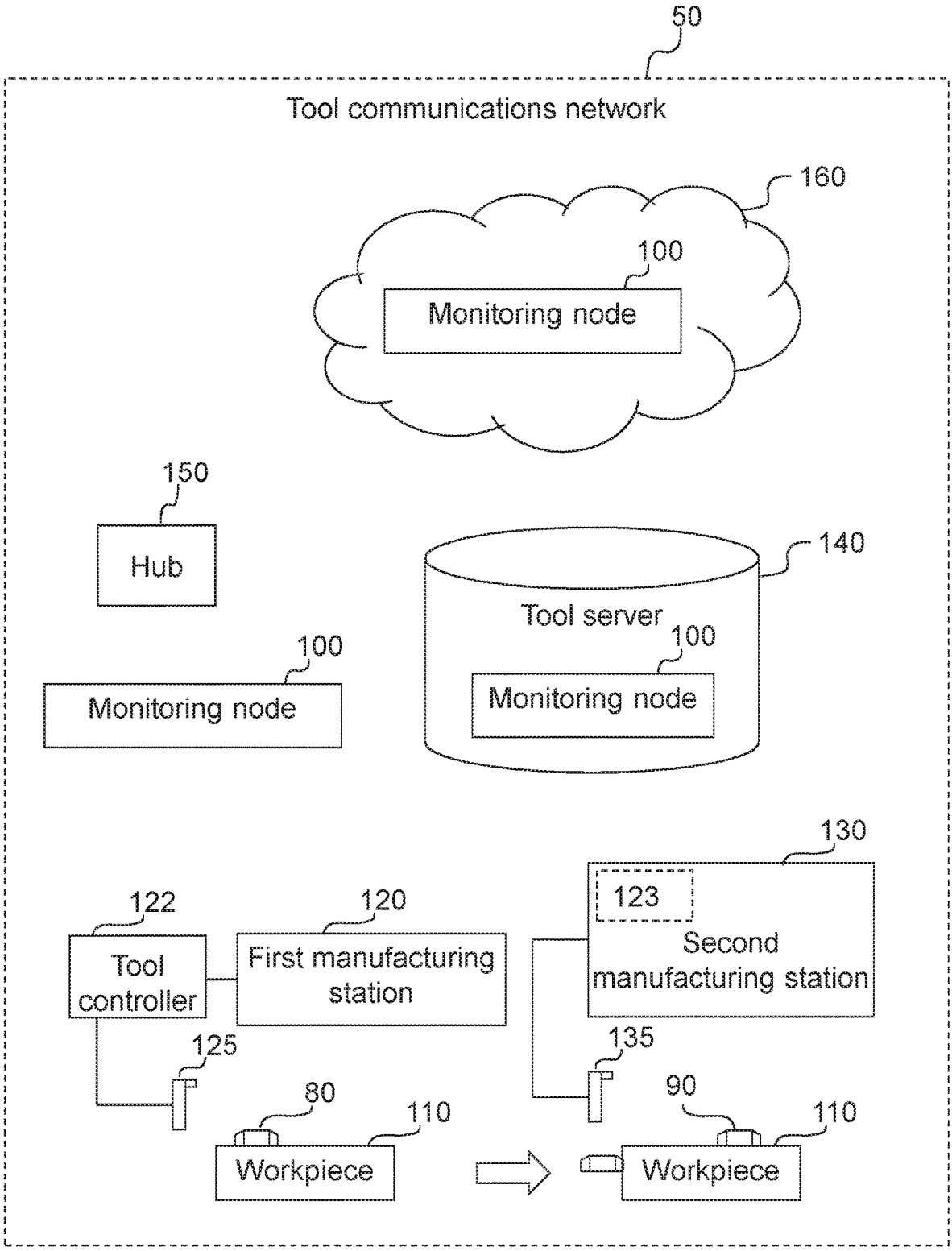
FIG. 1 is an overview of a tool communication network.

FIG. 1 shows an overview of the tool communications network 50. The tool communications network 50 may comprise tightening tools 125, 135 (or other power tools), tool controllers 122, 123, a tool server 140, a communication node (hub) 150 and a monitoring node 100. In FIG. 1 three different types of monitoring nodes are shown, which will be described further below. The tool communication network 50 is set up to support different manufacturing stations 120, 130 that are part of an assembly line. Usually there are more than two manufacturing stations in an assembly line, but in FIG. 1 only two are shown in order to illustrate an explanatory tool communications network 50. FIG. 1 also shows a workpiece 110 having a first joint 80 (a bolt in FIG. 1) that is to be tighten at a first manufacturing station 120 and a second joint 90 to be tighten at a second manufacturing station 130.

The tightening tools 125, 135 are connected with a respective tool controller 122, 123 for control, supervision and collection of result data from the tightening tools 125, 135. The tightening tools 125, 135 may be set up for simple operations such as tightening bolts as mentioned above. However, the tightening tools 125, 135 may also be set up for more complex work operations including a number of similar and different operations, series of operations with one equipment, shifting to another equipment followed by another series of operations and may be shifting to a third equipment. How the tightening tools 125, 135 should perform operations and interact with an operator may be based on control data received from the tool controllers 122, 123. Each individual operation may need to be performed with high accuracy in terms of e.g. torque and rotation speed. In order to maintain desirable quality control all results may be collected by sensors, such as the number of rotations, final torque, location of operation, time, and similar result data for tightening tool operation.

The tool controllers 122, 123 controlling the tightening tools 125, 135 and accessory equipment have the primary task to control the tightening tools 125, 135. The tool controllers 122, 123 also manage configuration data and collect sensor data and store the sensor data as results of performed work operations. The tool controller 122, 123 may be a specific node for control of tightening tools 125, 135 or it may be for example a general purpose computer, which has been adapted for control of tightening tools. The tool controllers 122, 123 may be connected to the tool communication network 50 by wire as the tool controller 122 or wirelessly as schematically shown by tool controller 123. The tool controllers 122, 123 may also be termed controller, controller node, controlling node, control unit, tool processor, tool regulator, or similar terms. The tool controller 122, 123 may be co-located or comprised by a tightening tool 125, 135, a tool server 140, communication node 150, or other suitable technical nodes operating in a tool communications network 50.

The tool server 140 is a server to which production managers or production technicians may connect for creation and/or administration of work operations for the tightening tools 125, 135. The tool server 140 may be a general purpose server or a tool server 140 specifically arranged for remote control of tightening tools 125, 135. Administrators connecting to the tool server may for example create, specify and change how a particular tightening tool or a group of tightening tools 125, 135 should behave in certain situations. Examples are series of operations, tool selections, values for each operation like a torque rate, number of rotations, rotational speed, position and how to end when result data should be feed backed to a tool server 140, etc.

A communication node or hub 150 may be managing communication between different participating functional nodes or devices in the communications network 50. The communication node 150 may for example keep track of identities of tool controllers 122, tool servers 140, or tightening tools 125, 135. The communication node 150 may keep track of any nodes or devices alternating between "on line" and "off line". A tool controller 122 may for example not always be connected to a network for various reasons. The communication node 150 may further validate and/or authorize nodes or devices communicating in the communications network 50, such that only authorized nodes have the right to communicate with each other.

The monitoring node 100, which is configured to monitor energy flow in the tightening tools 125, 135 may be part of the tool server 140, be provided as part of a cloud solution or be provided as a stand-alone server. The monitoring node 100 will be closer described in conjunction with FIG. 4.

Figure 2:
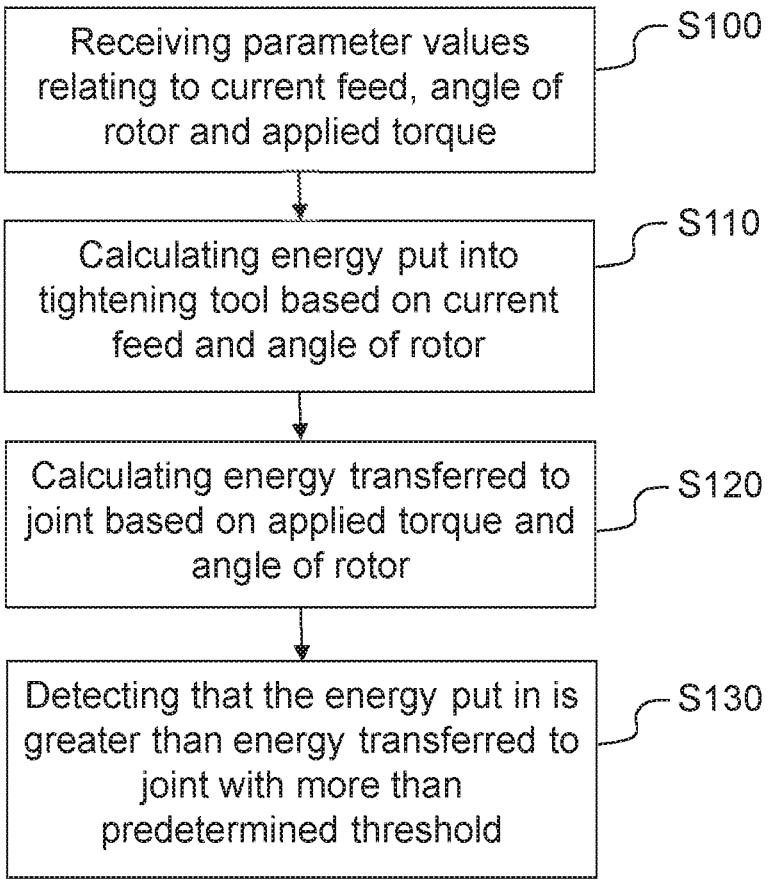
FIG. 2 is a flowchart of a method according to one possible embodiment.

Turning now to FIG. 2 a method performed by the monitoring node 100 will be described in more detail. The monitoring node 100 is associated with the tool communication network 50 for monitoring the energy flow in the tightening tools 125, 135 in for example an assembly line. As mentioned above the tightening tools 125, 135 are also connected to the communications network 50.

In a step, S100, of the method performed by the monitoring node 100, the monitoring node 100 receives, from the tightening tool 125, parameter values relating to current fed into the tightening tool 125, angle of a rotor in the tightening tool 125 and torque applied to a joint 80 by the tightening tool 125. As mentioned above the tightening tools 125, 135 are provided with different types of sensors with help of which the fed current, the rotor angle and applied torque may be directly or indirectly obtained. There are many possible sensors that may be used to obtain parameter values that are associated with the received parameter values. What is important in the context of the present invention is that the monitoring node 100 receives parameter values that are associated with the fed current, the rotor angle and applied torque.

Thereafter, in another step S110 the monitoring node calculates the energy put into to the tightening tool 125, 135 based on the received parameter values relating to the current fed into the tightening tool 125, 135 and the angle $\alpha$ of the rotor in the tightening tool.

In another step S120 the monitoring node 100 also calculates the energy transferred to the joint 80 by the tightening tool 125, 135 based on the received parameter values relating to the torque applied to the joint 80 by the tightening tool 125, 135 and the angle $\alpha$ of the rotor in the tightening tool 125, 135.

Based on these calculations, in step S110 and S120, the monitoring node 100 detects that the calculated energy put into to the tightening tool 125, 135 deviates from the calculated energy transferred to the joint 80 by the tightening tool 125, 135 with more than a predetermined value. For example the energy put into the tightening tool may be 10 kWh and the energy transferred to the joint 80 may be 8 kWh. In this case we have a deviation of 2 kWh or 20%. Thus, if the predetermined value is higher than 2 kWh or 20% the monitoring node 100 will detect the that the calculated energy put into to the tightening tool 125, 135 deviates from the calculated energy transferred to the joint 80 by the tightening tool 125, 135 with more than the predetermined value, i.e. 2 kWh or 20%. The predetermined value may be an arbitrary value that is set by a production technician or the like. It should be noted that the energy values mention above only are used to illustrate an example and will depend on the type of tightening tool 125, 135 that is used.

By calculating the energy put into the tightening tool 125, 135 and the energy that the tightening tool 125, 135 transfers to the joint 80, 90 and then comparing these two a lot may be learned or understood. Energy losses and tightening power can be calculated. If there for example is an energy loss or lower tightening power this might indicate that that there is an error in the tightening tool 125, 135. Furthermore, energy loss in one tightening tool 125 might be compared to the energy loss of another tightening tool 135 or tightening tools. The total amount of energy passing through the tightening tool 125, 135 and the total energy lost in the tightening tool can for example be used as an indicator of tightening tool life. If the energy required to tighten for example a bolt 80, 90 increases it is an indication that there is something wrong. Maybe the properties of the bolt 80, 90 have changed due to a new batch of bolts or maybe a transducer of the tightening tool 125, 135 has lost its calibration. Thus, using the energy flowing into and out of the tool and usage of the calculated data makes it easier to gain understanding if the tightening tool 125, 135 is failing, needs calibration or maybe there are unexpected changes in the parts being assembled in the assembly line.

Figure 3:
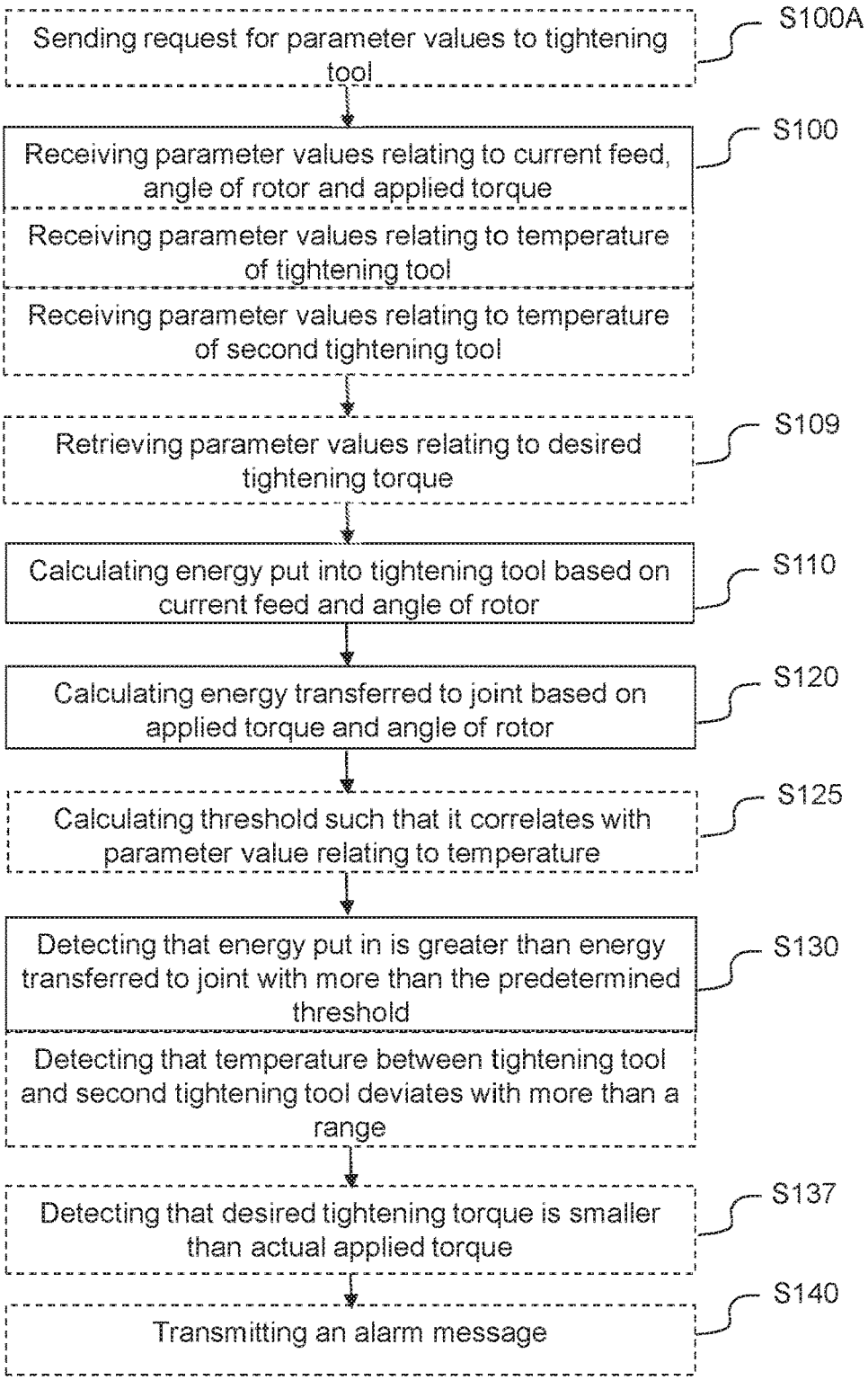
FIG. 3 is a flowchart of the method according to other possible embodiments.

With reference to FIG. 3 different embodiments and variations of the method performed by the monitoring node 100 will be will be closer described. The main steps described in conjunction with FIG. 2 are repeated in FIG. 3 and are shown with unbroken lines. Optional steps and variations are shown with dashed lines in FIG. 3.

In one embodiment the monitoring node 100 transmits, in step S140, an alarm message in response to detecting that the calculated energy put into to the tightening tool 125, 135 deviates from the calculated energy transferred to the joint 80 by the tightening tool 125, 135 with more than the predetermined value as mentioned above. This alarm message may be sent to the tool server 140 for storage and later access by the production manager or any other authorized person. The alarm message may also be sent to any other node in the communication network 50 or to any node connected thereto. The alarm message could for example be sent directly to a smart phone or any other device capable of receiving messages as a text message. Thus, be sending the alarm message it is possible to notify for example the production manager as soon as one discovers deviations larger than the predetermined value or threshold between energy put into to the tightening tool 125, 135 and the energy output by the tightening tool 125, 135. This gives the production manager an opportunity to go and observe how the tightening tool 125, 135 is used at a particular manufacturing station 120, 130 or by a particular operator.

In one embodiment the parameter values received in step S100, may be received more or less continuously or with regular intervals that are preprogrammed either in the tightening tool 125, 135 or in the tool controller 122, 123 controlling the tightening tool 125, 135. In another embodiment the parameter values are only received when requested by the monitoring node 100. Thus, in step S100A the monitoring node 100 sends a request for parameter values to the tightening tool 125, 135, via the communication network 50.

Another option when receiving parameter values in step S100, is to not only receive parameter values relating to current feed, angle of rotor and applied torque, but also receive parameter values relating to the temperature of the tightening tools 125, 135. The tightening tool temperature may be useful in order to perform other calculations which may be used to better diagnose what is wrong with the tightening tool 125, 135. For example in step S125 the monitoring mode 100 calculates the predetermined value such that it correlates with the parameter value relating to the temperature of the tightening tool 125, 135, i.e. increasing temperature leads to increasing the predetermined value. This is due to the fact that when the tightening tool 125, 135 becomes warmer it will lose more energy and the efficiency of the tightening tool 125, 135 decreases. However, in most cases, this is only natural and does not depend on a tightening tool error, but only on that the tightening tool is frequently used. Thus, by correlating the predetermined value with temperature the predetermined value will change dynamically with temperature and thus unnecessary alarm messages will not be sent in step S140. However, in one embodiment there might also be a threshold value above which the correlation no longer is made such that overheating of the tightening tool is avoided.

In yet another embodiment also a parameter value relating to a temperature of a second tightening tool 135 is received, from the second tightening tool 135 connected to the communication network 50. Furthermore, this embodiment comprises in step S130 detecting that the parameter value relating to the temperature of the tightening tool 125 deviates with more than a predetermined temperature range from the parameter value relating to the temperature of the second tightening tool 135. Comparing differences between different tightening tools might be useful when predicting tightening tool failure or material deficiencies. If the temperature of all tightening tools increases this may be an indication that there is a problem at the assembly line where the tools are located. If the temperature raises only for one tightening tool it is an indication that there is some problem at the manufacturing station of the tightening tool. The problem may either relate to the tightening tool itself or to some problems with the workpiece or parts thereof. If it possible to point out one specific tightening tool with elevated temperature the monitoring node 100 transmits in step S140 the alarm message comprising information about the deviation in the parameter values relating to the temperatures of the tightening tool 125 and the second tightening tool 135.

In another variation the method further comprises retrieving in step S109, a parameter value relating to desired tightening torque for tightening the joint 80. The monitoring node 100 then detects, in step S137, that the retrieved parameter value relating to the desired tightening torque deviates, from the received parameter value for the torque applied to the joint 80 by the tightening tool 125. With other words the applied torque is smaller than the desired tightening torque. This deviation triggers the transmission, in step S140, of the alarm message comprising information that the torque applied to the joint 80 is smaller than the desired tightening torque. This may indicate that the tightening tool needs to be recalibrated or that the tightening tool life is coming to an end.

Figure 4:
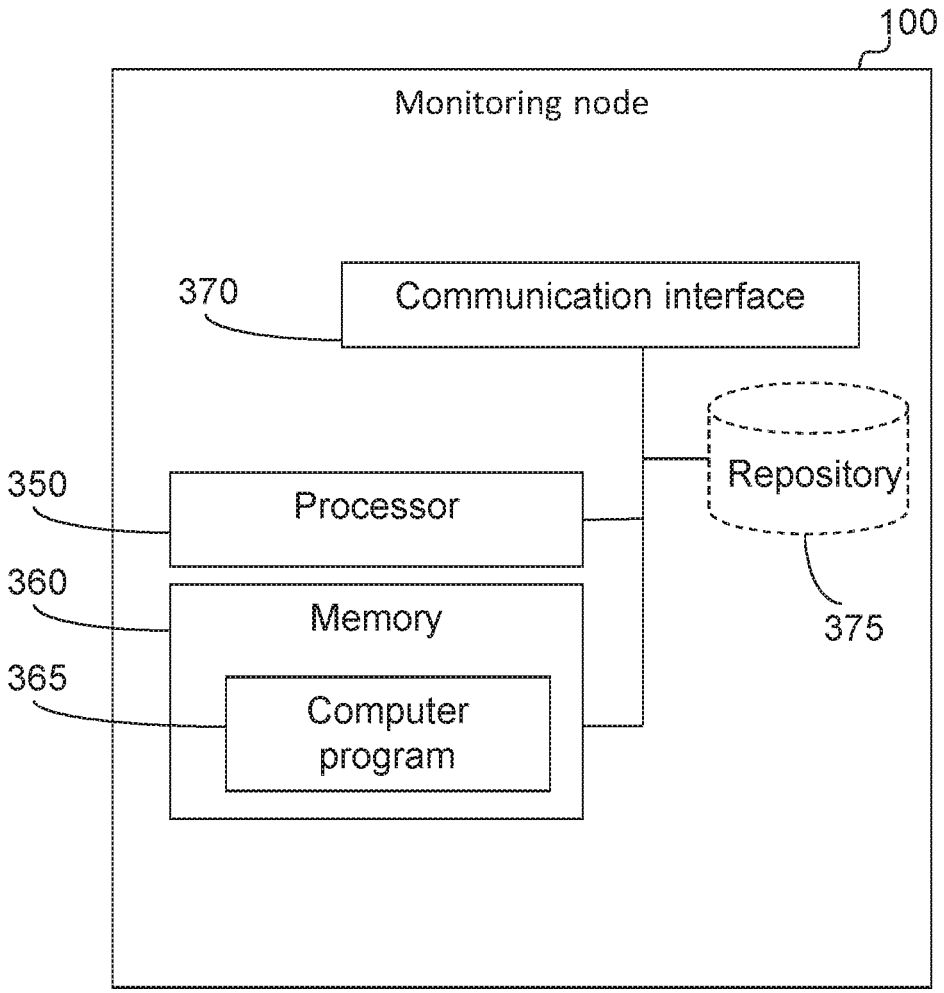
FIG. 4 is a block diagram illustrating the monitoring node in more detail, according to possible embodiments.

Turning now to FIG. 4 the monitoring node 100 be described closer. The monitoring node 100 comprises a processor 350, a memory 365 and a communication interface 370 for communication with other nodes and devices in the communication tool network 50, such as the tightening tools 125, 135.

Depending on the configuration the monitoring node 100 may further and as an option also comprise a repository 375. The repository may comprise historic data and/or different thresholds used to determine different types of errors or usage of the tightening tool and operator behavior of the tightening tool 125, 135. FIG. 4 further shows a computer program 365 comprising computer program code. The computer program code is adapted to implement the method steps, as described above, performed by the monitoring node 100 if executed on the processor 350. The computer program 365 may be stored on the memory 360, but may also be provided on a computer readable storage medium, such as a CD or a USB stick, that is loaded into the memory 360.

As mentioned above the monitoring node 100 is associated with the tool communication network 50, for monitoring the energy flow in the tightening tools 125, 135 and comprises the processor 350 and the memory 360. The memory 360 comprises instructions which when executed by the processor 350 causes the monitoring node 100 to receive, from the tightening tool 125, 135 parameter values relating to current fed into the tightening tool 125, 135 angle of a rotor in the tightening tool 125, 135 and torque applied to a joint 80 by the tightening 125, calculate the energy put into to the tightening tool 125, 135 based on the received parameter values relating to the current fed into the tightening tool 125, 135 and the angle of the rotor in the tightening tool 125, 135 and calculate the energy transferred to the joint 80 by the tightening tool 125 based on the received parameter values relating to the torque applied to the joint 80 by the tightening tool 125, 135 and the angle of the rotor in the tightening tool 125, 135. These calculations are then used by the monitoring node 100 to detect that the calculated energy put into to the tightening tool 125, 135 deviates from the calculated energy transferred to the joint 80 by the tightening tool 125, 135 with more than a predetermined value.

It should be understood that the monitoring node 100 is further configured to execute the computer program code of the computer program 365 such that the monitoring node 100 is caused to perform all of the method steps or actions described above in conjunction with FIGS. 2 and 3. Thus, these steps are not repeated here.

The processor 350 may comprise a single Central Processing Unit (CPU), or could comprise two or more processing units. For example, the processor 350 may include general purpose microprocessors, instruction set processors and/or related chips sets and/or special purpose microprocessors such as Application Specific Integrated Circuits (ASICs), Field Programmable Gate Arrays (FPGAs) or Complex Programmable Logic Devices (CPLDs). The processor 350 may also comprise a storage for caching purposes.

The computer program may be carried by computer program products in the described monitoring node 100, in the form of memories having a computer readable medium and being connected to the processor 350. The computer program products may be carried by a medium, such as CD, DVD, flash memory, or downloadable objects. Each computer program product or memory thus comprises a computer readable medium on which the computer program is stored e.g. in the form of computer program units. For example, the memories may be a flash memory, a Random-Access Memory (RAM), a Read-Only Memory (ROM) or an Electrically Erasable Programmable ROM (EEPROM), and the program unit's u could in alternative embodiments be distributed on different computer program products in the form of memories within the described monitoring node 100 or within the tool communication network 50.

While the solution has been described with reference to specific exemplary embodiments, the description is generally only intended to illustrate the inventive concept and should not be taken as limiting the scope of the solution. For example, the terms "tool communications network", "monitoring node", "tool server", "tightening tool" and "tool controller" have been used throughout this description, although any other corresponding nodes, functions, and/or parameters could also be used having the features and characteristics described here. The solution is defined by the appended claims.

The invention claimed is:

1. A method performed by a monitoring node associated with a tool communication network of monitoring energy flow in a tightening tool connected to the communication network, the method comprising:

receiving, from the tightening tool, parameter values relating to current fed (I) into the tightening tool, angle ($\alpha$) of a rotor in the tightening tool and torque (T) applied to a joint by the tightening tool;

calculating energy input to the tightening tool based on the received parameter values relating to the current fed (I) into the tightening tool and the angle ($\alpha$) of the rotor in the tightening tool;

calculating energy transferred to the joint by the tightening tool based on the received parameter values relating to the torque applied to the joint by the tightening tool and the angle ($\alpha$) of the rotor in the tightening tool; and detecting that the calculated energy input to the tightening tool deviates from the calculated energy transferred to the joint by the tightening tool by more than a predetermined value.

2. The method according to claim 1, further comprising transmitting an alarm message in response to detecting that the calculated energy input to the tightening tool deviates from the calculated energy transferred to the joint by the tightening tool by more than a predetermined value.

3. The method according to claim 1, further comprising sending a request for parameter values to the tightening tool via the communication network.

4. The method according to claim 1, wherein the receiving step comprises receiving, from the tightening tool, a parameter value relating to a temperature of the tightening tool, and calculating the predetermined value such that it correlates with the parameter value relating to the temperature of the tightening tool.

5. The method according to claim 2, wherein:

the receiving step comprises receiving, from a second tightening tool connected to the communication network, a parameter value relating to a temperature of the second tightening tool, the detecting step comprises detecting that the parameter value relating to the temperature of the tightening tool deviates by more than a predetermined temperature range from the parameter value relating to the temperature of the second tightening tool, and transmitting the alarm message comprises transmitting information about the deviation in the parameter values relating to the temperatures of the tightening tool and the second tightening tool.

6. The method according to claim 2, further comprising:

retrieving a parameter value relating to desired tightening torque for tightening the joint; and detecting that the retrieved parameter value relating to the desired tightening torque deviates from the received parameter value for the torque (T) applied to the joint by the tightening tool, wherein transmitting the alarm message comprises transmitting information that the desired tightening torque deviates from the received parameter value for the torque (T) applied to the joint by the tightening tool.

7. A monitoring node associated with a tool communication network for monitoring energy flow in a tightening tool connected to the communication network, the monitoring node comprising a processor and a memory, the memory comprising instructions which when executed by the processor cause the monitoring node to:

receive, from the tightening tool, parameter values relating to current fed (I) into the tightening tool, angle ($\alpha$) of a rotor in the tightening tool and torque (T) applied to a joint by the tightening tool;

calculate the energy input to the tightening tool based on the received parameter values relating to the current fed (I) into the tightening tool and the angle ($\alpha$) of the rotor in the tightening tool;

calculate the energy transferred to the joint by the tightening tool based on the received parameter values relating to the torque applied to the joint by the tightening tool and the angle ($\alpha$) of the rotor in the tightening tool; and detect that the calculated energy input to the tightening tool deviates from the calculated energy transferred to the joint by the tightening tool by more than a predetermined value.

8. The monitoring node according to claim 7, which is further caused to transmit an alarm message in response to detecting that the calculated energy input to the tightening tool deviates from the calculated energy transferred to the joint by the tightening tool by more than a predetermined value.

9. The monitoring node according to claim 7, which is further caused to send a request for parameter values to the tightening tool via the communication network.

10. The monitoring node according to claim 7, which is further caused to:

receive, from the tightening tool, a parameter value relating to a temperature of the tightening tool; and calculate the predetermined value such that it correlates with the parameter value relating to the temperature of the tightening tool.

11. The monitoring node according to claim 8, which is further caused to:

receive, from a second tightening tool connected to the communication network, a parameter value relating to a temperature of the second tightening tool; and detect that the parameter value relating to the temperature of the tightening tool deviates by more than a predetermined temperature range from the parameter value relating to the temperature of the second tightening tool, wherein transmitting the alarm message comprises transmitting information about the deviation in the parameter values relating to the temperatures of the tightening tool and the second tightening tool.

12. The monitoring node according to claim 8, which is further caused to:

retrieve a parameter value relating to desired tightening torque for tightening the joint; and detect that the received parameter value relating to the desired tightening torque deviates from the received parameter value for the torque (T) applied to the joint by the tightening tool, wherein transmitting the alarm message comprises transmitting information that the desired tightening torque is smaller than the received parameter value for the torque (T) applied to the joint by the tightening tool.

13. A computer program comprising computer program code, the computer program code adapted, if executed on a processor, to implement the method according to claim 1.

14. A computer program product comprising a computer-readable storage medium, the computer-readable storage medium having the computer program according to claim 13.

15. The method according to claim 2, further comprising sending a request for parameter values to the tightening tool via the communication network.

16. The method according to claim 2, wherein the receiving step comprises receiving, from the tightening tool, a parameter value relating to a temperature of the tightening tool, and calculating the predetermined value such that it correlates with the parameter value relating to the temperature of the tightening tool.

17. The method according to claim 3, wherein the receiving step comprises receiving, from the tightening tool, a parameter value relating to a temperature of the tightening tool, and calculating the predetermined value such that it correlates with the parameter value relating to the temperature of the tightening tool.

18. The method according to claim 15, wherein the receiving step comprises receiving, from the tightening tool, a parameter value relating to a temperature of the tightening tool, and calculating the predetermined value such that it correlates with the parameter value relating to the temperature of the tightening tool.

19. The monitoring node according to claim 8, which is further caused to send a request for parameter values to the tightening tool via the communication network.

20. The monitoring node according to claim 8, which is further caused to:

receive, from the tightening tool, a parameter value relating to a temperature of the tightening tool; and calculate the predetermined value such that it correlates with the parameter value relating to the temperature of the tightening tool.

* * * * *